US006502498B2

(12) United States Patent
Shull et al.

(10) Patent No.: US 6,502,498 B2
(45) Date of Patent: Jan. 7, 2003

(54) METHOD AND APPARATUS FOR LIFTING A WORK IMPLEMENT ATTACHED TO A WORK MACHINE

(75) Inventors: Andrew G. Shull, Washington, IL (US); Everett G. Brandt, Brimfield, IL (US); Robert J. McGee, Cleveland, OH (US)

(73) Assignee: Caterpillar Inc, Peoria, IL (US)

( * ) Notice: Subject to any disclaimer, the term of this patent is extended or adjusted under 35 U.S.C. 154(b) by 53 days.

(21) Appl. No.: 09/840,258

(22) Filed: Apr. 23, 2001

(65) Prior Publication Data

US 2002/0152885 A1 Oct. 24, 2002

(51) Int. Cl.[7] ..... F15B 11/22; B66F 9/00
(52) U.S. Cl. ..... 91/171; 60/327; 414/700
(58) Field of Search ..... 91/515, 171; 60/327; 414/700

(56) References Cited

U.S. PATENT DOCUMENTS 2,883,077 A * 4/1959 Pilch ..... 414/700
3,795,152 A 3/1974 Campbell
4,469,007 A 9/1984 Melocik
4,844,685 A * 7/1989 Sagaser ..... 414/700
5,501,570 A * 3/1996 Mozingo ..... 414/700
5,669,282 A 9/1997 Tanino et al.
5,678,470 A 10/1997 Koehler et al.
5,737,933 A 4/1998 Cobo et al.
5,878,363 A 3/1999 Koehler
5,974,352 A 10/1999 Shull
6,185,493 B1 2/2001 Skinner et al.

* cited by examiner

*Primary Examiner*—Edward K. Look
*Assistant Examiner*—Michael Leslie
(74) *Attorney, Agent, or Firm*—Steve D Lundquist

(57) ABSTRACT

A method and apparatus for lifting a work implement attached to a work machine. The method and apparatus includes delivering a lift command to a hydraulic lift circuit, diverting a portion of the lift command to a hydraulic tilt circuit, and responsively tilting the work implement to a rack-back position in cooperation with lifting the work implement.

25 Claims, 6 Drawing Sheets

METHOD AND APPARATUS FOR LIFTING A WORK IMPLEMENT ATTACHED TO A WORK MACHINE

TECHNICAL FIELD

This invention relates generally to a method and apparatus for lifting a work implement attached to a work machine and, more particularly, to a method and apparatus for automatically tilting the work implement as the work implement is being lifted.

BACKGROUND

Work machines, such as wheel loaders, track loaders, and the like, are often used to dig material from a location such as a pile. For example, a wheel loader may be used to dig gravel, sand, dirt, and the like, from a pile for transport and loading somewhere else. The wheel loader typically includes an attached work implement, such as a bucket, to perform the dig operation.

It is usually most efficient when digging from a pile to move the bucket into the material, and then lift the bucket while simultaneously tilting the bucket in a backwards direction, known as "racking" the bucket. An optimal amount of material is then captured by the bucket in one efficient series of motions. However, this series of steps requires a skilled operator for smooth and efficient performance, particularly when operating a wheel loader which has separate control levers for lifting and tilting of the bucket.

Advances have been made in automating the dig process of a wheel loader when engaging a pile of material. An exemplary patent with respect to automated digging operations is shown by U.S. Pat. No. 5,974, 352, to Andrew G. Shull. However, automated digging by a wheel loader may not always be desired. In many situations, it would be preferable to continue using a manual system, yet enhance the manual operations with partial automated control for those procedures which require advanced operator skill.

The present invention is directed to overcoming one or more of the problems as set forth above.

SUMMARY OF THE INVENTION

In one aspect of the present invention a method for lifting a work implement attached to a work machine is disclosed. The method includes the steps of delivering a lift command to a hydraulic lift circuit, diverting a portion of the lift command to a hydraulic tilt circuit, and responsively tilting the work implement to a rack-back position in cooperation with lifting the work implement.

In another aspect of the present invention an apparatus for lifting a work implement attached to a work machine is disclosed. The apparatus includes an operator controlled lever for delivering a lift command, a hydraulic lift circuit for receiving the lift command and responsively lifting the work implement, a hydraulic tilt circuit, and means for receiving a portion of hydraulic control from the hydraulic lift circuit and responsively delivering the portion to the hydraulic tilt circuit for tilting the work implement to a rack-back position in cooperation with lifting the work implement.

DETAILED DESCRIPTION

Figure 1:
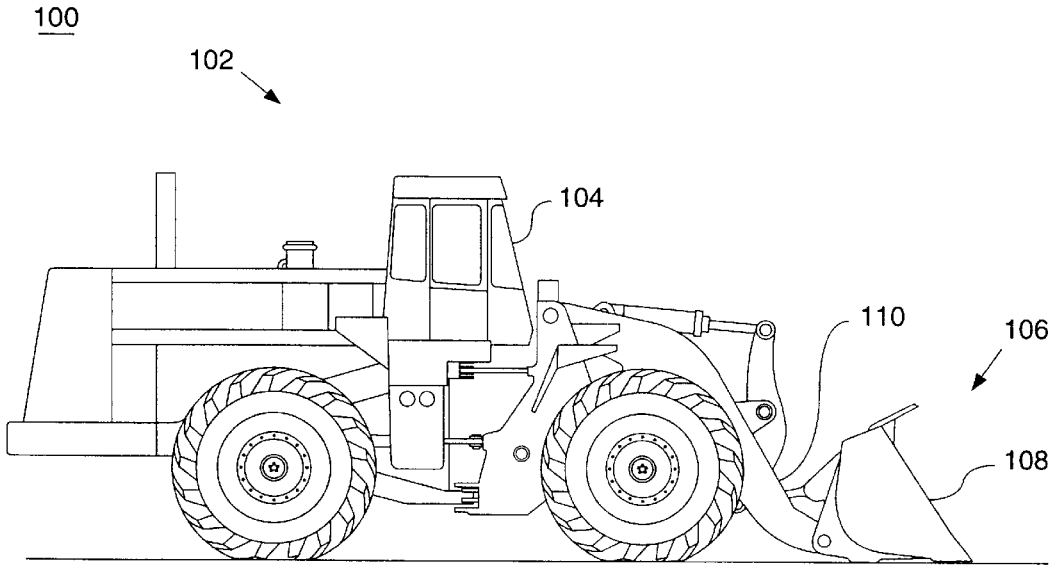
FIG. 1 is a diagrammatic illustration of a work machine having an attached work implement suited for use with the present invention.

Referring to the drawings, a method and apparatus 100 for lifting a hydraulically controlled work implement 106 attached to a work machine 102 is shown. With particular reference to FIG. 1, the work machine 102 is depicted as a wheel loader 104. However, other types of work machines, e.g., track-type loaders, backhoe loaders, skid steer loaders, and the like, may be used with the present invention as well. The work implement 106 of FIG. 1 is shown as a bucket 108, used for digging and lifting material. It is noted that other types of work implements, e.g., blades, tele-handlers, grapples, and the like, could also be used. The bucket 108 is preferably attached to the wheel loader 104 by means of a boom 110.

Figure 2:
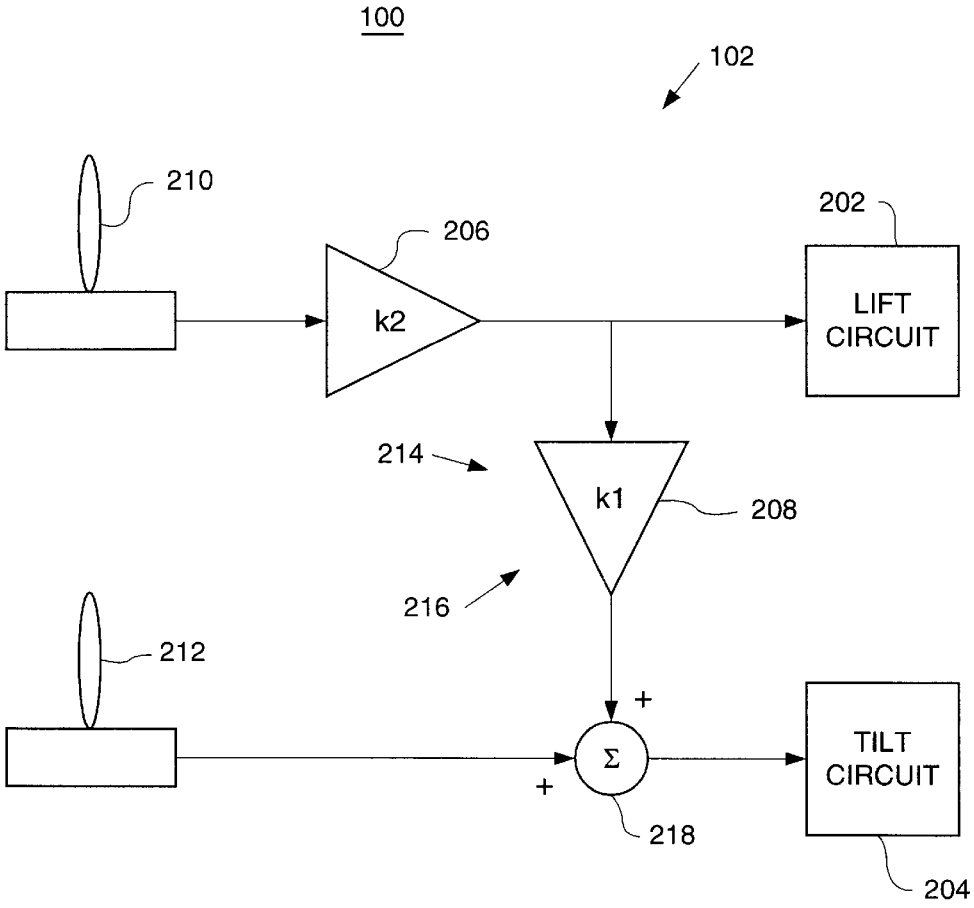
FIG. 2 is a control diagram illustrating a preferred embodiment of the present invention.
Figure 3:
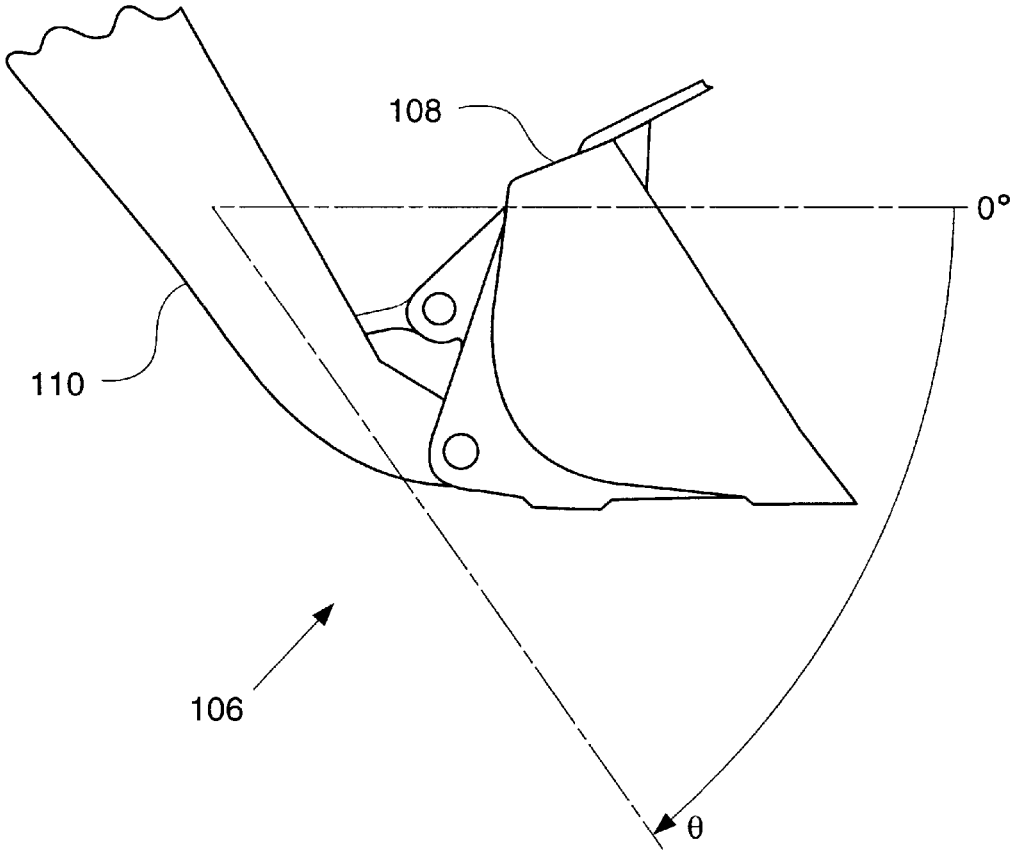
FIG. 3 is a diagrammatic illustration of a portion of the work implement indicating a lift angle.

Referring to FIG. 2, a control diagram illustrating a preferred embodiment of the present invention is shown. In the preferred embodiment, the work implement 106 is hydraulically controlled by the use of a hydraulic lift circuit 202 and a hydraulic tilt circuit 204. The hydraulic lift circuit 202 is primarily used to lift the work implement 106 and the hydraulic tilt circuit 204 is primarily used to tilt the work implement. For example, a wheel loader 104 having a bucket 108 attached is typically used to dig into a pile of loose material, such as gravel or dirt, and to lift the bucket load of material by the use of the hydraulic lift circuit 202, while simultaneously "racking", i.e., tilting back, the bucket 108 by the use of the hydraulic tilt circuit 204. Racking of the bucket 108 essentially tilts the bucket to a "rack-back position, thus maintaining the load of material within the bucket 108.

Preferably, the hydraulic control is by means of electro-hydraulic control. Hydraulic control circuits, and electro-hydraulic control circuits, are well known in the art and need not be described further.

In the preferred embodiment, an operator controls lifting of the work implement 106 by the use of a lift command lever 210. In like manner, the operator controls tilting of the work implement 106 by the use of a tilt command lever 212. Preferably, lifting and tilting functions are performed when needed by simultaneous operation of the lift and tilt command levers 210,212. However, simultaneous use of the lift and tilt command levers 210,212 tend to require considerable skill and experience for efficient operations.

In one embodiment, commands from the lift command lever 210 are delivered to a lift gain circuit 206 for processing before delivery to the hydraulic lift circuit 202. The lift gain circuit 206 provides a controlled signal to the hydraulic lift circuit 202, as depicted by a graph 502 of lift gain vs. lift angle in FIG. 5, and as described in more detail below. In an alternate embodiment, the lift gain circuit 206 is not used, and control signals from the lift command lever 210 are delivered directly to the hydraulic lift circuit 202.

Figure 4:
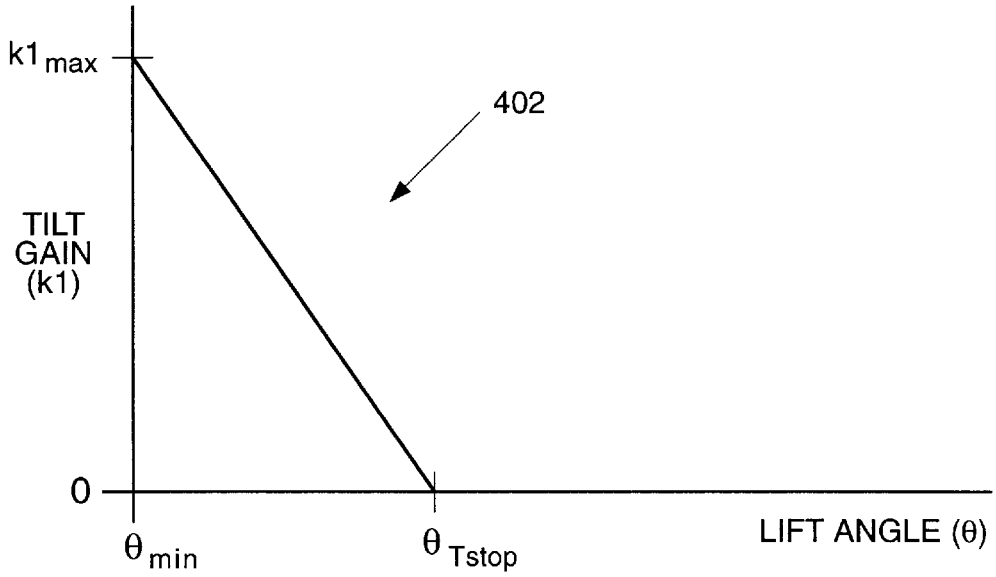
FIG. 4 is a graph illustrating a first aspect of the control diagram of FIG. 2.

In a preferred embodiment of the present invention, means 214 for receiving a portion of hydraulic control from the hydraulic lift circuit 202 and responsively delivering the portion to the hydraulic tilt circuit 204 are used. Preferably, the means 214 includes a divertor 216, for example, a tilt gain circuit 208. The portion of hydraulic control, i.e., a portion of the lift command, which is diverted from the hydraulic lift circuit 202 is used by the hydraulic tilt circuit 204 for tilting the work implement 106 to a rack-back position in cooperation with lifting the work implement 106. For example, the diverted portion of hydraulic control from the hydraulic lift circuit 202 is used to responsively tilt the bucket 108 of a wheel loader 104 to a rack-back position as the bucket 108 is lifted. A graph 402 of tilt gain vs. lift angle is illustrated in FIG. 4, and, as is described in more detail below, shows an example of a controlled signal provided by the tilt gain circuit 208 to the hydraulic tilt circuit 204.

An operator may desire to use the tilt command lever 212 during lifting of the work implement 106 to deliver a tilt command supplemental with the diverted portion of the lift command. For example, the operator may want to provide further control over the tilt operation of the bucket 108 during lifting. The signal from the tilt command lever 212 is delivered to a summer 218, where the operator introduced signal is added to the diverted lift command signal for delivery to the hydraulic tilt circuit 204. Alternatively, the operator may leave the tilt command lever 212 in a neutral position, thus allowing the system to simultaneously lift and tilt the work implement 106 in response to activation of the lift command lever 210 alone.

Figure 6:
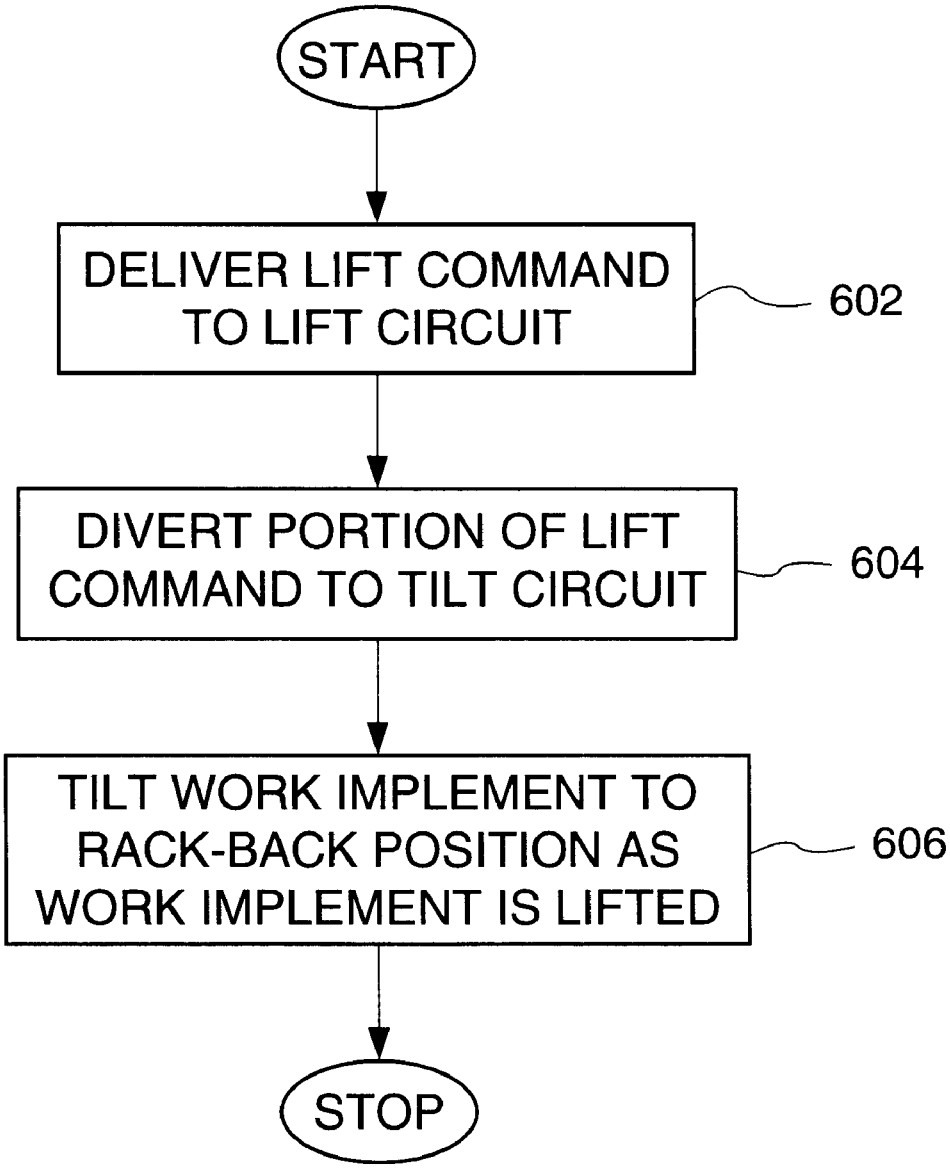
FIG. 6 is a flow diagram illustrating a preferred method of the present invention.

Referring to FIG. 6, a flow diagram illustrating a preferred method of the present invention is shown.

In a first control block 602, a lift command is delivered to the hydraulic lift circuit 202, preferably, by means of the lift gain circuit 206. The lift command is delivered by operator control of the lift command lever 210.

Figure 5:
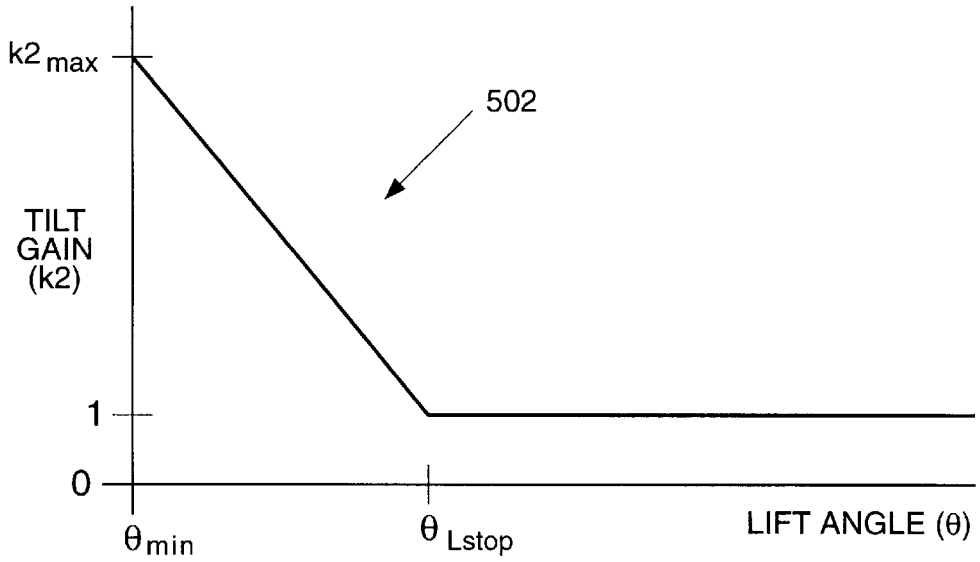
FIG. 5 is a graph illustrating a second aspect of the control diagram of FIG. 2.

In FIG. 5, a value of lift gain of 1 is indicative of an amount of lift gain desired to lift the bucket 108 without any diversion of hydraulic lift control to the hydraulic tilt circuit 204. Thus, a lift gain of 1 indicates a reference or unity gain. However, since some hydraulic lift control is diverted to the hydraulic tilt circuit 204 for simultaneous tilting of the work implement 106, an additional amount of lift gain is desired from the lift gain circuit 206. In the exemplary response curve of FIG. 5, the lift gain initially is at a value of $k2_{max}$ at an angle of $\Theta_{min}$, e.g., −40°, and decreases linearly until a value of 1 is reached at an angle of $\Theta_{Lstop}$. It is noted that $\Theta_{Lstop}$ refers to an angle of the boom 110 in which it is desired for the lift gain circuit 206 to stop modifying the lift command, and does not refer to any position of the boom 110 or bucket 108 for which the lifting process is stopped. More specifically, at $\Theta_{Lstop}$ the lift gain is at unity value and is maintained at such value for the remainder of the lifting operation.

The response curve shown on the graph 502, although linearly decreasing, may be of any type response desired to provide adequate diverted lift gain to the hydraulic tilt circuit 204 without sacrificing the lift gain needed for the hydraulic lift circuit 202. For example, the curve may decrease exponentially or by some other fashion. Furthermore, the slope of the curve and the value of $k2_{max}$ may be changed as needed.

In a second control block 604, a portion of the lift command is diverted to the hydraulic tilt circuit 204. Preferably, the diverted portion is delivered to the tilt gain circuit 208, for controlled delivery to the hydraulic tilt circuit 204. The graph 402 of tilt gain vs. lift angle in FIG. 4 shows an exemplary response curve in which the tilt gain decreases linearly from a value of $k1_{max}$ at $\Theta_{min}$ to a value of 0 at $\Theta_{Tstop}$. Thus, the tilt gain circuit 208 is adapted to provide a maximum amount of tilt gain initially, and reduce the amount of tilt gain delivered as the boom 110 is lifted. It is noted that $\Theta_{Tstop}$ refers to an angle of the boom 110 in which it is desired for the tilt gain circuit 206 to stop modifying the diverted lift command, and does not refer to any position of the boom 110 or bucket 108 for which the lifting or tilting process is stopped.

The response curve shown on the graph 402, although linearly decreasing, may be of any type response desired to provide adequate tilt gain to the hydraulic tilt circuit 204 without sacrificing the tilt gain needed for the hydraulic tilt circuit 204. For example, the curve may decrease exponentially or by some other fashion. Furthermore, the slope of the curve and the value of $k1_{max}$ may be changed as needed.

With continued reference to FIG. 6, in a third control block 606, the work implement 106 is tilted to a rack-back position as the work implement 106 is lifted. More specifically, the work implement 106 is lifted in response to an operator supplied command from the lift command lever 210, as the work implement 106 is simultaneously racked, i.e., tilted back, in response to a diverted portion of the lift command from the hydraulic lift circuit 202 to the hydraulic tilt circuit 204.

INDUSTRIAL APPLICABILITY

As an example of an application of the present invention, a wheel loader 104 with a bucket 108 attached is used to dig material from a pile. For example, the material may be rocks, gravel, sand, dirt, salt, or some other loose material, and it may be desired to dig buckets of the material to move to another location, such as the bed of a truck being loaded.

The dig process preferably requires driving the bucket 108 into the pile, and lifting the bucket 108 while simultaneously tilting the bucket 108 to a rack-back position to hold a full bucket of material. In a wheel loader 104 having separate lift and tilt command levers 210,212, the operator must drive the bucket 108 into the pile and operate both the lift and tilt command levers 210,212 at the same time. This operation requires considerable skill.

The present invention allows an operator to simultaneously lift and tilt a bucket 108 by activation of the lift command lever 210 alone since a portion of hydraulic control from the lift command is diverted to the hydraulic tilt circuit 204 in an automatic and controlled manner.

Other aspects, objects, and features of the present invention can be obtained from a study of the drawings, the disclosure, and the appended claims.

What is claimed is:

1. A method for lifting a hydraulically controlled work implement attached to a work machine, including the steps of:

delivering a lift command to a hydraulic lift circuit;

diverting a portion of the lift command to a hydraulic tilt circuit; and responsively tilting the work implement to a rack-back position in cooperation with lifting the work implement.

2. A method, as set forth in claim 1, wherein delivering a lift command includes the step of delivering an operator controlled lift command.

3. A method, as set forth in claim 2, wherein delivering a lift command includes the step of providing a controlled lift gain to the hydraulic lift circuit.

4. A method, as set forth in claim 3, wherein the controlled lift gain decreases from a maximum gain value to a minimum gain value in proportion to an increasing lift angle of the work implement.

5. A method, as set forth in claim 1, wherein diverting a portion of the lift command to a hydraulic tilt circuit includes the step of providing a controlled tilt gain to the hydraulic tilt circuit.

6. A method, as set forth in claim 5, wherein the controlled tilt gain decreases from a maximum gain value to a minimum gain value in proportion to an increasing tilt angle of the work implement.

7. A method, as set forth in claim 2, further including the step of delivering an operator controlled tilt command to the hydraulic tilt circuit, the operator controlled tilt command being delivered supplemental with the diverted portion of the lift command.

8. A method for lifting a hydraulically controlled bucket attached to a loading machine, including the steps of:

delivering an operator controlled lift command to a hydraulic lift circuit;

diverting a portion of hydraulic control from the hydraulic lift circuit to a hydraulic tilt circuit; and responsively tilting the bucket to a rack-back position as the bucket is lifted.

9. A method, as set forth in claim 8, wherein delivering an operator controlled lift command includes the step of providing a controlled lift gain to the hydraulic lift circuit.

10. A method, as set forth in claim 9, wherein the controlled lift gain decreases linearly from a maximum gain value to a minimum gain value as the bucket is lifted.

11. A method, as set forth in claim 8, wherein diverting a portion of hydraulic control from the hydraulic lift circuit to a hydraulic tilt circuit includes the step of providing a controlled tilt gain to the hydraulic tilt circuit.

12. A method, as set forth in claim 11, wherein the controlled tilt gain decreases linearly from a maximum gain value to a minimum gain value as the bucket is tilted.

13. A method, as set forth in claim 8, further including the step of delivering an operator controlled tilt command to the hydraulic tilt circuit, the operator controlled tilt command and the diverted portion of the hydraulic control from the hydraulic lift circuit adding together to tilt the bucket to a rack-back position as the bucket is lifted.

14. An apparatus for lifting a hydraulically controlled work implement attached to a work machine, comprising:

an operator controlled lever for delivering a lift command;

a hydraulic lift circuit for receiving the lift command and responsively lifting the work implement;

a hydraulic tilt circuit; and means for receiving a portion of hydraulic control from the hydraulic lift circuit and responsively delivering the portion to the hydraulic tilt circuit for tilting the work implement to a rack-back position in cooperation with lifting the work implement.

15. An apparatus, as set forth in claim 14, wherein the hydraulically controlled work implement is electro-hydraulically controlled.

16. An apparatus, as set forth in claim 15, further including a lift gain circuit for providing a controlled lift gain to the hydraulic lift circuit.

17. An apparatus, as set forth in claim 16, wherein the controlled lift gain decreases from a maximum gain value to a minimum gain value in proportion to an increasing lift angle of the work implement.

18. An apparatus, as set forth in claim 15, wherein the means for receiving a portion of hydraulic control from the hydraulic lift circuit and responsively delivering the portion to the hydraulic tilt circuit includes a tilt gain circuit.

19. An apparatus, as set forth in claim 18, wherein the tilt gain circuit is adapted to provide a controlled tilt gain to the hydraulic tilt circuit which decreases from a maximum gain value to a minimum gain value in proportion to an increasing tilt angle of the work implement.

20. An apparatus, as set forth in claim 15, further including an operator controlled lever for delivering a tilt command to the hydraulic tilt circuit, the operator controlled tilt command adapted to be delivered supplemental with the portion of the tilt command from the hydraulic lift circuit.

21. An apparatus for lifting an electro-hydraulically controlled bucket attached to a loading machine, comprising:

an operator controlled lever for delivering a lift command;

a hydraulic lift circuit for receiving the lift command and responsively lifting the bucket;

a hydraulic tilt circuit; and a diverter for receiving a portion of hydraulic control from the hydraulic lift circuit and responsively delivering the portion to the hydraulic tilt circuit for tilting the bucket to a rack-back position as the bucket is lifted.

22. An apparatus, as set forth in claim 21, further including a lift gain circuit for providing a controlled lift gain to the hydraulic lift circuit.

23. An apparatus, as set forth in claim 22, wherein the controlled lift gain decreases linearly from a maximum gain value to a minimum gain value as the bucket is lifted.

24. An apparatus, as set forth in claim 21, wherein the diverter includes a tilt gain circuit adapted to provide a controlled tilt to the hydraulic circuit which decreases from a maximum gain value to a minimum gain value as the bucket is tilted.

25. An apparatus, as set forth in claim 21, further including an operator controlled lever for providing a tilt command to the hydraulic tilt circuit, the operator controlled tilt command and the diverted portion of the hydraulic control from the hydraulic lift circuit being adapted to add together to tilt the bucket to a rack-back position as the bucket is lifted.

* * * * *